US010723417B2

(12) United States Patent
Poscente

(10) Patent No.: US 10,723,417 B2
(45) Date of Patent: Jul. 28, 2020

(54) WATER SKI FIN

(71) Applicant: Jay Poscente, Calgary (CA)

(72) Inventor: Jay Poscente, Calgary (CA)

(73) Assignee: COMPETITION SYSTEMS INC., Calgary (CA)

( * ) Notice: Subject to any disclaimer, the term of this patent is extended or adjusted under 35 U.S.C. 154(b) by 0 days.

(21) Appl. No.: 16/350,565

(22) Filed: Dec. 4, 2018

(65) Prior Publication Data

US 2020/0172208 A1 Jun. 4, 2020

(51) Int. Cl.

*B63B 35/81* (2006.01)
*B63B 32/20* (2020.01)
*B63B 32/60* (2020.01)

(52) U.S. Cl.

CPC ..... *B63B 32/20* (2020.02); *B63B 32/60* (2020.02)

(58) Field of Classification Search

CPC ..... B63B 35/81; B63B 35/7926
See application file for complete search history.

(56) References Cited

U.S. PATENT DOCUMENTS 4,439,166 A * 3/1984 Maxwell ..... B63B 32/20 441/79
5,299,963 A * 4/1994 Isensee ..... B63B 32/20 441/79
8,845,374 B2 * 9/2014 Higgins ..... B63B 32/66 441/79

* cited by examiner

*Primary Examiner* — S. Joseph Morano
*Assistant Examiner* — Jovon E Hayes
(74) *Attorney, Agent, or Firm* — Cassan Maclean IP Agency Inc.

(57) ABSTRACT

A fin for a slalom water ski includes a planar body with a convex leading edge and a slot proximate such leading edge. The slot has an arcuate front or leading edge and a wavy rear edge defined by alternating crests and troughs or projections which allow the fin to be smaller without compromising its ability to support ski acceleration. The smaller size allows the ski to be turned more easily. A line of small holes extending in a row proximate the leading edge of the fin body can achieve the same result.

6 Claims, 3 Drawing Sheets

WATER SKI FIN

FIELD OF INVENTION

This invention relates to a fin for a water ski; and in particular to a fin for a slalom water ski.

BACKGROUND OF THE INVENTION

Standard slalom water ski fins, which have been in use for more than thirty years have four or five holes in the bottom and back to avoid sudden losses of traction at the tail of the ski due to cavitation. This method of water flow management requires a large fin for strong acceleration across a slalom course. In fact, the standard slalom fin is so large that it makes turning a ski difficult.

An object of the present invention is to provide a slalom ski fin which solves the turning problem without compromising maximum acceleration of a ski.

SUMMARY OF THE INVENTION

Accordingly, the present invention relates to a water ski fin comprising a planar body having a top end, mounting elements on said top end for mounting the fin on a water ski, a convex leading edge, a trailing edge and a bottom rear corner connecting the leading edge to the trailing edge; and one slot proximate said leading edge of the body, said slot including an arcuate leading edge having the same curvature as the leading edge of the body and a wave-shaped trailing edge including alternating projections formed by crests and troughs.

BRIEF DESCRIPTION OF THE DRAWINGS

The invention is described below in greater detail with reference to the accompanying drawings, which illustrate a preferred embodiment of the invention, and wherein.

DETAILED DESCRIPTION OF THE INVENTION

Figure 1:
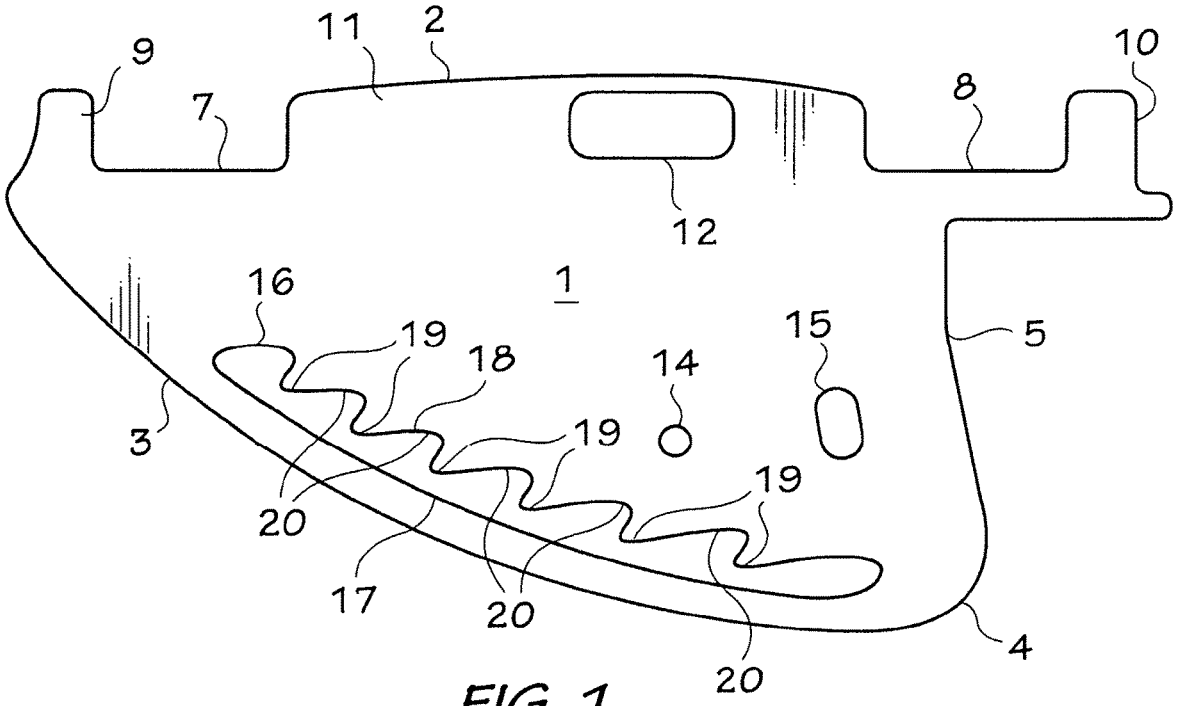
FIG. 1 is a side view of one embodiment of a slalom ski fin in accordance with the present invention.

With reference to FIG. 1, one embodiment of the water ski fin includes a thin, planar body 1 having a top edge 2, a convex leading edge 3 flowing into a bottom, rear corner 4, and a concave rear or trailing edge 5. Notches 7 and 8 in the top edge 2 separate front and rear ears 9 and 10, respectively from a large central projection 11 which contains a window 12. The fingers 9 and 10, the projection 11 and the window 12, which are standard on most tournament water ski fins, define mounting elements used to mount the fin in the trailing end of a ski. A pair of holes 14 and 15 are used to mount adjustable wings (not shown) on the body 1.

In the following description of FIGS. 1 to 5, the same reference numbers have been used to identify the same or similar elements of the fins.

In the fin of FIG. 1, water flow from the front to the back of the fin is controlled by an elongated, arcuate slot 16 extending parallel to the leading edge 3. The slot 16 has a smooth, arcuate leading edge 17, which has a similar curvature, i.e., is generally parallel to the leading edge 3 of the fin, and a wavy rear edge 18. The wavy rear edge 18 is defined by alternating wave-like projections shown as crests 19 and troughs 20. The projections 19 manage water flow patterns on the low pressure side of the fin body 1. Thus, the fin of the present invention controls water flow dynamics primarily from the front of the fin, significantly reducing drag and unwanted lift.

Figure 2:
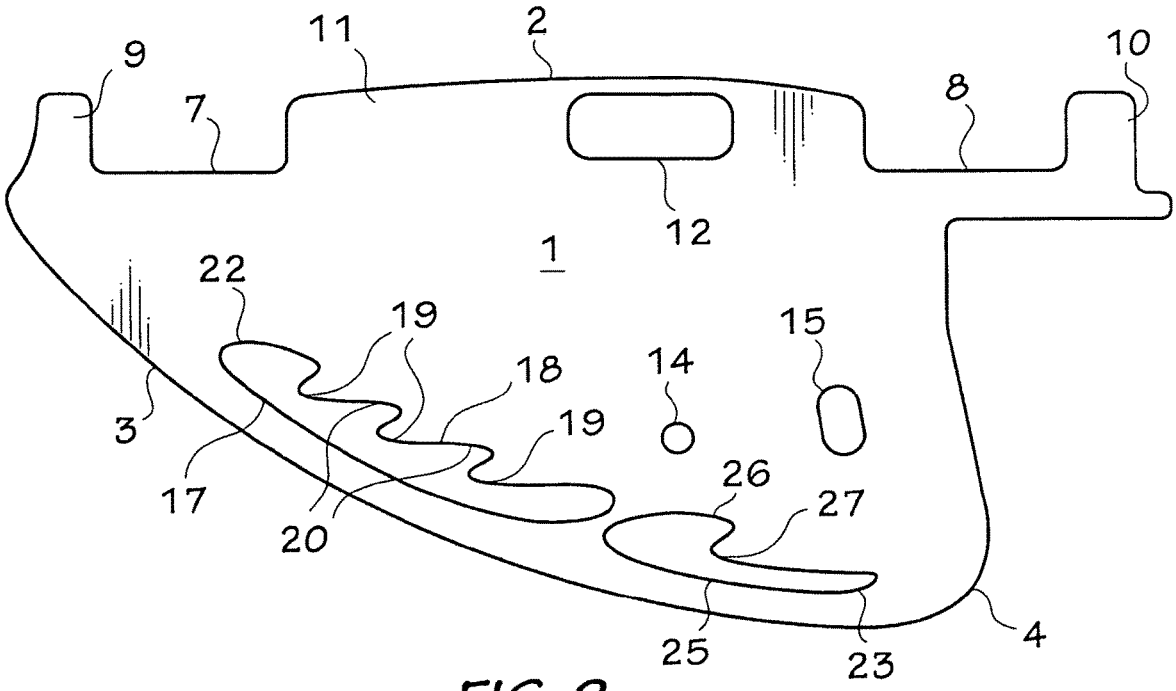
FIG. 2 is a side view of a second embodiment of a slalom ski fin in accordance with the invention.

The second embodiment of the invention which is shown in FIG. 2 includes a pair of slots 22 and 23 extending generally parallel to the leading edge 3 of the fin. The slot 22 similar in shape and orientation to the slot 16 in the first embodiment of the fin, but the slot 22 is shorter than the slot 16, including a wavy trailing edge 18 with fewer projections 19 and grooves 20. The second slot 23 is located rearwardly and below the slot 22. The slot 23 includes a leading, bottom edge 25 generally parallel to the leading edge 3 of the fin body 1, and a top edge 26 with a single projection 27.

Figure 3:
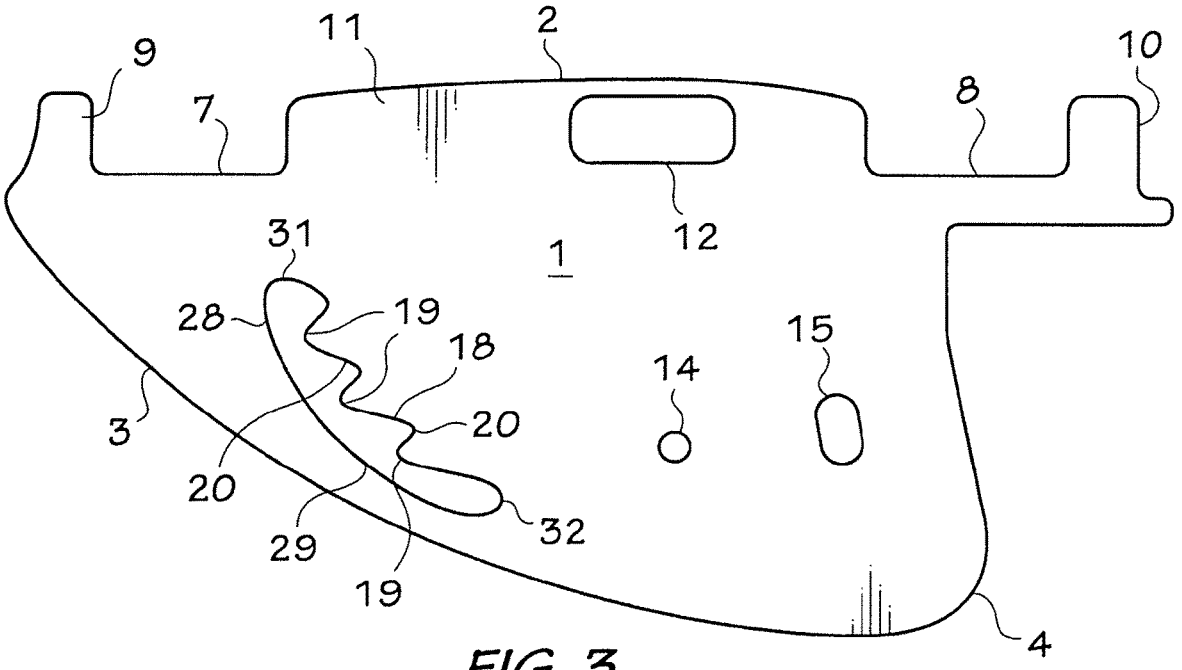
FIG. 3 is a side view of a third embodiment of a slalom ski fin in accordance with the invention.

As shown in FIG. 3, the third embodiment of the invention includes a slot 28, the arcuate leading edge 29 of which is not parallel to the leading edge 3 of the body 1. The slot 28 is closer to the vertical than the slot 16 or 22, i.e., the top end 31 of the slot 28 is farther away from the edge 3 than its bottom end 32.

Figure 4:
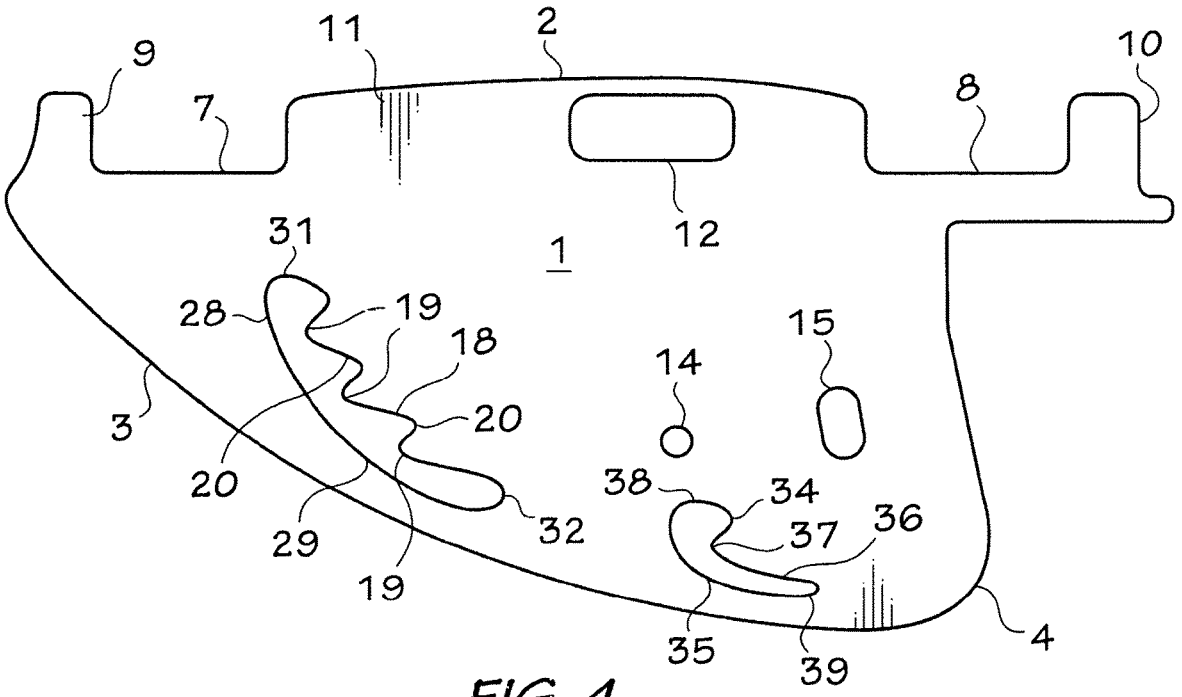
FIG. 4 is a side view of a fourth embodiment of a slalom ski fin in accordance with the invention.

The embodiment of the invention shown in FIG. 4 includes a slot 28 similar to the same slot in FIG. 3, and a second slot 34 beneath and rearwardly of the slot 28. The slot 34 is generally comma-shaped and includes a convex leading edge 35 and a trailing edge 36 with a single projection 37. The top end 38 of the slot 34 is farther from the leading edge 3 of the fin than the trailing edge 39.

Figure 5:
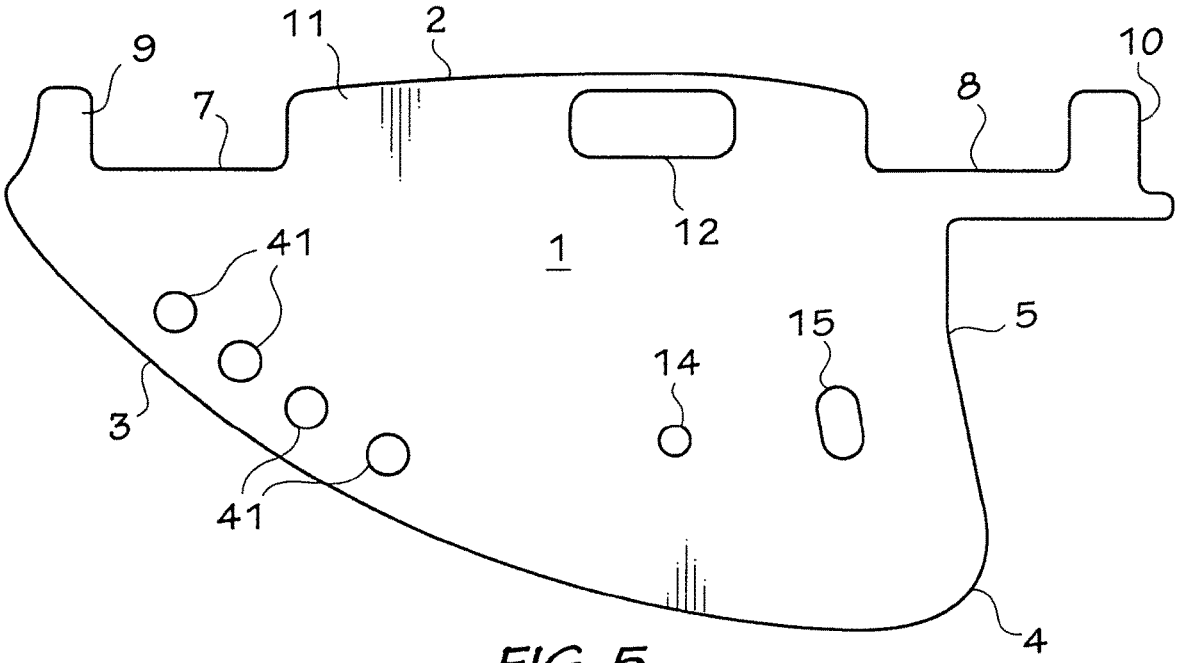
FIG. 5 is a side view of a fifth embodiment of a slalom ski fin in accordance with the invention.

The fifth embodiment of the invention shown in FIG. 5 includes a plurality of holes 41 extending in a row not necessarily parallel to but proximate the leading edge 3 of the fin body 1. The holes 41, which may or may not be equidistant apart perform the same function as the projections in the other embodiments of the invention.

Figure 6:
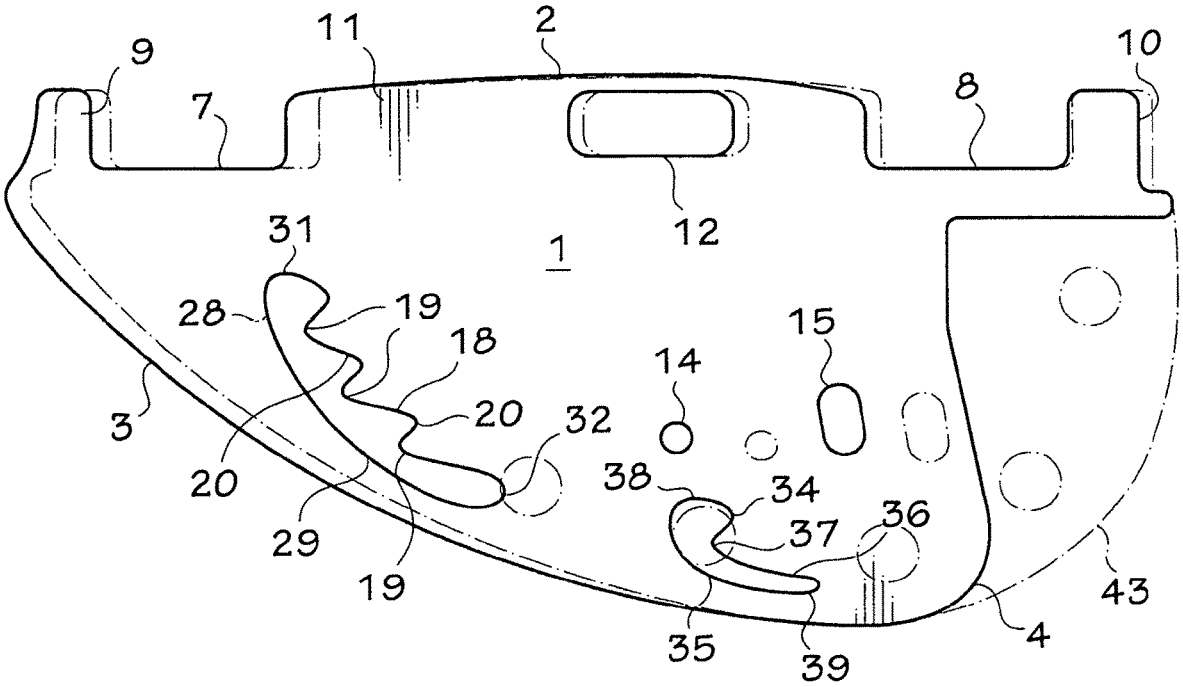
FIG. 6 is a side view of the ski fin of FIG. 2 overlying a standard water ski fin.

FIG. 6 shows the fin of FIG. 4 overlying a standard slalom ski fin 43. Because of its unique forward slot and projection design, the fin of the present invention can be made smaller than a standard tournament ski fin without compromising its ability to make the ski accelerate. The turning of a ski equipped with a smaller fin is easier than the turning of a ski with a standard fin.

The invention claimed is:

1. A water ski fin comprising a planar body having a top end, mounting elements on said top end for mounting the fin on a water ski; a convex leading edge, a trailing edge and a bottom rear corner connecting the leading edge to the trailing edge; and one slot proximate said leading edge of the body, said slot including an arcuate leading edge having the same curvature as the leading edge of the body and a wave-shaped trailing edge including alternating crests and troughs.

2. The water ski fin of claim 1, wherein said leading edge of said one slot is generally parallel to said leading edge of said fin body.

3. The water ski fin of claim 2 including a second slot rearwardly and beneath said one slot, said second slot having a lower leading edge generally parallel to said leading edge of said fin body.

4. A water ski fin comprising a planar body having a top end, mounting elements on said top end for mounting the fin on a water ski; a convex leading edge, a trailing edge and a bottom rear corner connecting the leading edge to the trailing edge;

and one slot proximate said leading edge of the body, said slot including an arcuate leading edge and a wave-shaped trailing edge including alternating crests and troughs.

5. The water ski fin of claim 4, wherein said one slot is inclined with respect to said leading edge of said body, a top end of said slot being a greater distance from said leading edge of the body than a bottom end of the slot.

6. The water ski fin of claim 5, including a second slot rearwardly and beneath said first slot, said second slot having a trailing edge with a single, forwardly extending projection.

* * * * *